US011158978B2

(12) United States Patent
Giesbrecht et al.

(10) Patent No.: US 11,158,978 B2
(45) Date of Patent: Oct. 26, 2021

(54) ELECTRICAL CONNECTOR HAVING A LOCKING CLIP

(71) Applicant: HARTING Electric GmbH & Co. KG, Espelkamp (DE)

(72) Inventors: Peter Giesbrecht, Porta Westfalica (DE); Sebastian Griepenstroh, Lübbecke (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 429 days.

(21) Appl. No.: 16/330,393

(22) PCT Filed: Nov. 20, 2017

(86) PCT No.: PCT/DE2017/100993
§ 371 (c)(1),
(2) Date: Mar. 5, 2019

(87) PCT Pub. No.: WO2018/103783
PCT Pub. Date: Jun. 14, 2018

(65) Prior Publication Data

US 2021/0288440 A1 Sep. 16, 2021

(30) Foreign Application Priority Data

Dec. 8, 2016 (DE) ..... 10 2016 123 817.1

(51) Int. Cl.
*H01R 13/629* (2006.01)
*H01R 13/627* (2006.01)
*H01R 13/639* (2006.01)

(52) U.S. Cl.
CPC ... *H01R 13/62955* (2013.01); *H01R 13/6275* (2013.01); *H01R 13/62938* (2013.01); *H01R 13/639* (2013.01)

(58) Field of Classification Search
CPC ..... H01R 13/6275; H01R 13/62955; H01R 13/62938; H01R 13/639
See application file for complete search history.

(56) References Cited

U.S. PATENT DOCUMENTS 5,873,737 A 2/1999 Hashizawa et al.
5,888,081 A 3/1999 Konoya et al.
(Continued)

FOREIGN PATENT DOCUMENTS

CN 1175804 C 11/2004
CN 105098483 A 11/2015
(Continued)

OTHER PUBLICATIONS

Krause, Werner Konstruktionselemente der Feinmechanik. 3. Auflage. München: Hanser, 2004. S.450.—ISBN 3-446-22336-3.

*Primary Examiner* — Oscar C Jimenez
(74) *Attorney, Agent, or Firm* — Smartpat PLC

(57) ABSTRACT

The invention relates to an electrical connector (1), having at least one first cut-out introduced in the electrical connector housing (2), a bolt (11) movably arranged in said first cut-out, and a locking clip (3), which is pivotably attached to the electrical connector housing (2) and which has at least one second cut-out, wherein the at least one first cut-out and the at least one second cut-out are aligned with each other in a state of locking to a mating electrical connector and the bolt (11) arranged in the at least one first cut-out protrudes into the at least one second cut-out of the locking clip (3), whereby the locking clip (3) is fastened in the pivoting motion thereof.

9 Claims, 3 Drawing Sheets

(56) References Cited

U.S. PATENT DOCUMENTS

| | | | | |
|---|---|---|---|---|
| 6,755,674 | B2 * | 6/2004 | Fujii | H01R 13/506 439/157 |
| 7,641,485 | B2 * | 1/2010 | Shibata | H01R 13/62938 439/157 |
| 9,337,580 | B2 * | 5/2016 | Temmesfeld | H01R 13/639 |
| 10,218,116 | B1 * | 2/2019 | Muldowney | H01R 13/641 |
| 10,270,205 | B2 * | 4/2019 | Nishio | H01R 13/6215 |
| 2003/0036313 | A1 | 2/2003 | Bollin et al. | |
| 2008/0139023 | A1 | 6/2008 | Furio et al. | |
| 2010/0151714 | A1 * | 6/2010 | Ambo | H01R 13/62955 439/157 |
| 2011/0250770 | A1 * | 10/2011 | Suzuki | H01R 24/28 439/157 |
| 2011/0250771 | A1 * | 10/2011 | Suzuki | H01R 13/62933 439/157 |
| 2013/0130525 | A1 | 5/2013 | Hachadorian | |
| 2014/0127924 | A1 | 5/2014 | Kim | |
| 2014/0184158 | A1 * | 7/2014 | Osawa | B60L 11/1818 320/109 |
| 2014/0273566 | A1 | 9/2014 | Allgood et al. | |
| 2018/0175549 | A1 | 6/2018 | Nishio et al. | |

FOREIGN PATENT DOCUMENTS

| | | | |
|---|---|---|---|
| CN | 105846230 | A | 8/2016 |
| CN | 104103960 | B | 12/2016 |
| DE | 29805975 | U1 | 6/1998 |
| DE | 19705798 | C2 | 10/1999 |
| DE | 20113501 | U1 | 10/2001 |
| DE | 102007058949 | A1 | 6/2008 |
| DE | 102011018379 | A1 | 10/2012 |
| EP | 2973875 | B1 | 10/2017 |
| JP | 2004273344 | A | 9/2004 |
| WO | 2012019625 | A1 | 2/2012 |
| WO | 2013132808 | A1 | 9/2013 |
| WO | 2016185904 | A1 | 11/2016 |

* cited by examiner

ELECTRICAL CONNECTOR HAVING A LOCKING CLIP

TECHNICAL FIELD

The disclosure relates to a plug connector, and more specifically to a plug connector having a locking clip which is pivotably attached to a connector housing.

BACKGROUND

Plug connectors are used to transmit currents and/or electrical signals. They may be used in harsh environments where the plug connectors are frequently exposed to dirt, dust and/or moisture. In particular, such plug connectors are used in agricultural technology. Particularly harsh and also dirty conditions often prevail here.

DE 201 13 501 U1 discloses a plug connector having a locking clip pivotably attached thereto. In a mated state the plug connector can be reversibly locked to a mating plug connector via the locking clip.

The locking clips can be simply pivoted back, whereby the locking of the plug connector and mating plug connector can be simply released. If the plug connector and mating plug connector become mutually disconnected during operation of a machine or a device, significant damage can occur to the corresponding machines or devices. Disconnection of the plug connector and mating plug connector during operation is also known as a so-called "removal under load". Such a "removal under load" may cause damage to the machines or the devices, and can also constitute a health risk for a user due to a so-called overvoltage arc.

SUMMARY

The object of the invention consists in proposing a plug connector which ensures increased safety during operation. Moreover, the plug connector should be easy to handle.

The object is achieved by the subject matter of the independent claim.

Advantageous configurations of the invention are indicated in the dependent claims.

The plug connector proposed here comprises a plug connector housing having a locking clip pivotably attached thereto. The plug connector has at least one first cutout, in which a bolt is directly or indirectly arranged or movably mounted. Indirect arrangement or mounting would mean, for example, that the bolt is encompassed by at least one further component and this component is arranged directly in the cutout. The locking clip has at least one second cutout.

If the plug connector is in a mated state with a mating plug connector and the locking clip is pivoted in a locking position over the mating plug connector, the cutout of the plug connector housing is flush with the cutout of the locking clip. In the mated state with the mating plug connector, the bolt projects into the cutout of the locking clip, whereby the locking clip is fixed in its in terms of its pivotal movement.

The plug connector could also have duplicate first cutouts, in which a respective bolt is arranged. In addition to the first cutouts, the locking clip would then also have two second cutouts which can be aligned to correspond with the first cutouts via a pivotal movement of the locking clip.

The bolt is preferably arranged in a trough part and the trough part is in turn arranged in the cutout of the plug connector housing. This could also refer to an indirect arrangement of the bolt in the cutout.

In a preferred embodiment, the bolt is mounted on a spring in the trough part. The spring force drives the bolt out of the cutout. If the cutouts of the plug connector housing and the locking clip are flush, the bolt is pressed into the cutout of the locking clip by the spring force.

The trough part preferably projects into the mating area of the plug connector in the unmated state. If the plug connector is mated with a mating plug connector, the mating plug connector penetrates into the mating area of the plug connector and thus pushes the trough part outwards. The contour of the trough part which projects into the mating face is formed to be correspondingly rounded. The trough part is pressed out of the mating area in the direction of the locking clip by a mating-side border of the mating face of the mating plug connector. Via the above-described spring-loading between the trough part and bolt, the bolt is therefore also subjected to a force directed outwards. If the locking clip is in a position in which the cutouts of the plug connector housing and the locking clip are not mutually aligned, the bolt is pressed against the locking clip and the spring is thereby tensioned. If the locking clip is then pivoted over the mating plug connector for locking purposes, whereby the cutouts of the plug connector housing and locking clip are brought into a mutually flush position, the bolt is pressed into the cutout of the locking clip by the spring force, whereby the locking clip is fixed in terms of its pivotal movement.

In a preferred variant, a guide element is arranged in the cutout of the plug connector. The guide element can be screw-fastened in the cutout. The guide element is operatively connected to the trough part in a resilient manner. The trough part can be held by the guide element, for example via latching hooks.

Alternatively, the trough part is simply pushed from the outside into the bore in the plug connector housing and held by the screw-in connection with the guide part. The bore itself has a step so that the larger diameter of the trough part cannot be pressed in further.

The bolt is preferably movably mounted in the guide element. The guide element enables an accurately guided movement of the bolt outwards (out of the housing) and inwards (into the mating area of the housing).

In a particularly advantageous variant, an actuator is movably mounted in the cutout of the locking clip. The actuator is operatively connected to the bolt. A force in the axial direction relative to the bolt can be exerted on said bolt via the actuator. The bolt can thus be removed from the cutout of the locking clip again. The locking clip can now be pivoted away from the mating plug connector again, whereby the locking between the plug connector and mating plug connector is released. The plug connector and the mating plug connector can be mutually disconnected and transferred to the unmated state. As a result of the active use of the actuator, this will be a conscious undertaking on the part of the user. Inadvertent "removal under load" is thus prevented.

The plug connector preferably has a cover against which the mating face of the plug connector is sealed in a media-tight manner in the unmated state. The mating face is thus effectively prevented from becoming dirty in the unmated state. The cover is preferably mechanically connected to the locking clip. Upon a pivotal movement of the locking clip for mating the plug connector, the cover is also simultaneously pivoted away from the mating face of the plug connector.

The invention moreover relates to a system comprising a plug connector having a pivotable locking clip and a matching mating plug connector, wherein the locking clip is fixed in terms of its pivotal movement in the mated state. The locking clip is preferably a U-shaped clip, which has cutouts on both sides, which reach over locking pins of the mating plug in the locked state.

BRIEF DESCRIPTION OF THE DRAWINGS

An exemplary embodiment of the invention is illustrated in the drawings and will be explained in more detail below. The drawings show.

DETAILED DESCRIPTION

The figures contain partially simplified, schematic illustrations. Identical reference signs are sometimes used for elements which are similar, but possibly not identical. Varying views of similar elements could be drawn to different scales.

Figure 1:
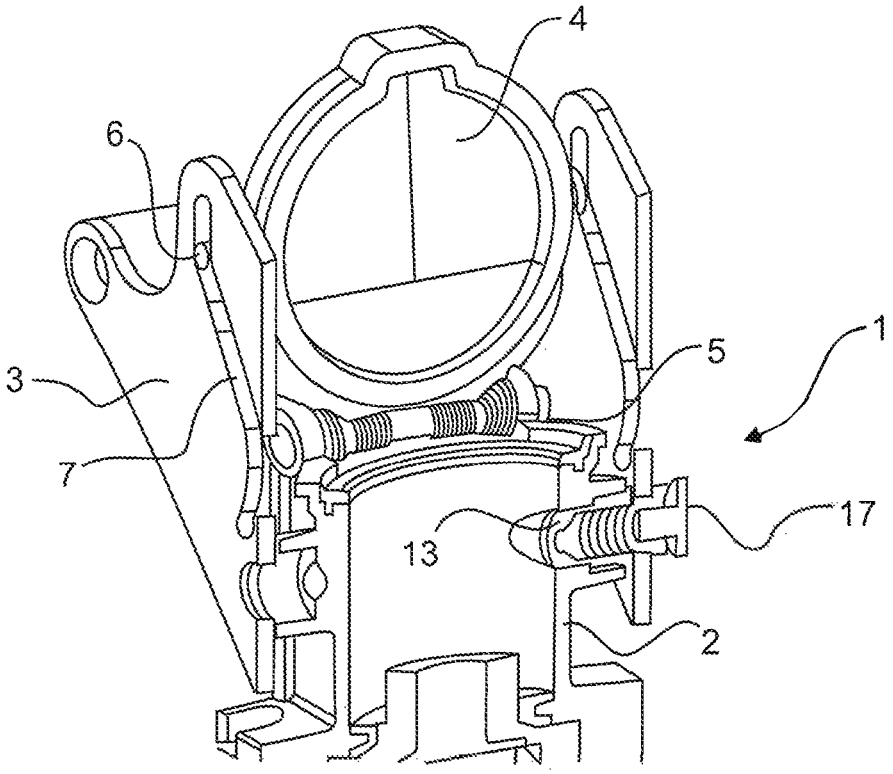
FIG. 1 is a perspective sectional illustration along the axial axis of a plug connector.
Figure 2:
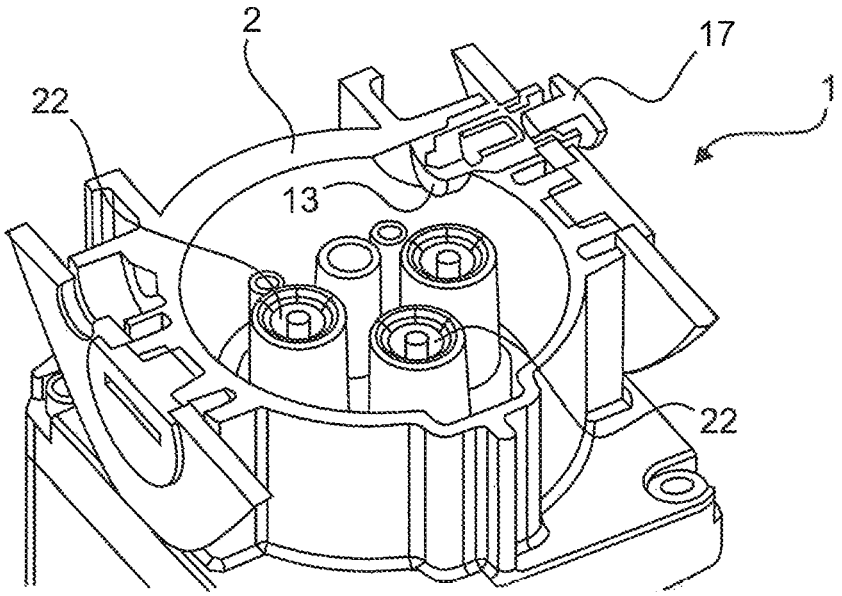
FIG. 2 is a perspective sectional illustration along the radial axis of a plug connector.

A sectional illustration in the axial direction through the mating area of a plug connector 1 is shown in FIG. 1. A substantially U-shaped locking clip 3 is pivotably mounted on the plug connector housing 2. A cover 4 is pivotably fastened to the plug connector housing 2 on the mating side. The mating face of the plug connector 1 can be closed in a media-tight manner via the cover 4. The cover 4 is operatively connected to a spring 5 fastened to the plug connector housing 2. The cover 4 is loaded with a force by the spring 5, which drives the cover 4 into its closed sealing position. The cover 4 has pins 6 on the side, which extend within a guide groove 7 of the locking clip 3. The cover 4 is thereby pivoted away from its sealing position when the locking clip 3 is pivoted correspondingly away from the plug connector housing 2, along the arrow 8.

Contact elements 22, which transmit the electrical currents or signals, are arranged in the plug connector housing 2. However, contact elements 22 which transmit pneumatic or FOC signals can also be provided.

The plug connector housing 2 has at least one cutout, in which a guide element 12 is fastened in a captive, for example screw-connected, manner. A bolt 11 is movably mounted in the guide element 12. A trough part 13 is latched or held on the guide element 12 on the mating-area side such that it is displaceable in the radial direction. The guide element 12 and the trough part 13 are operatively connected via a spiral spring 15. A spiral spring 14, which operatively connects the trough part 13 and the bolt 11, is arranged within the bolt 11, which has a hollow design. A guide element 16 is fastened in a cutout of the locking clip 3. A substantially T-shaped actuator 17 is captively fastened in the guide element 16 with the aid of a blocking ring 18.

The trough part 13 is pressed into the mating area of the plug connector 1 by the spring force of the spiral spring 15. By inserting a mating plug connector 10 into the mating area of the plug connector 1, the trough part 13 is pressed radially outwards out of the mating area.

Figure 3:
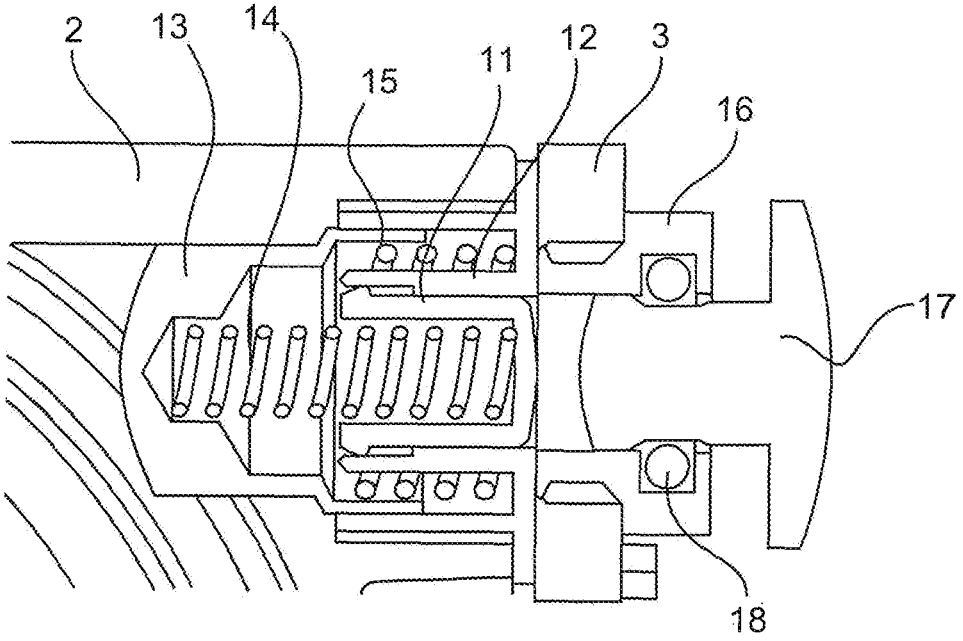
FIG. 3 is a sectional illustration of a cutout in the plug connector housing and a cutout, flush therewith, in the locking clip.
Figure 4:
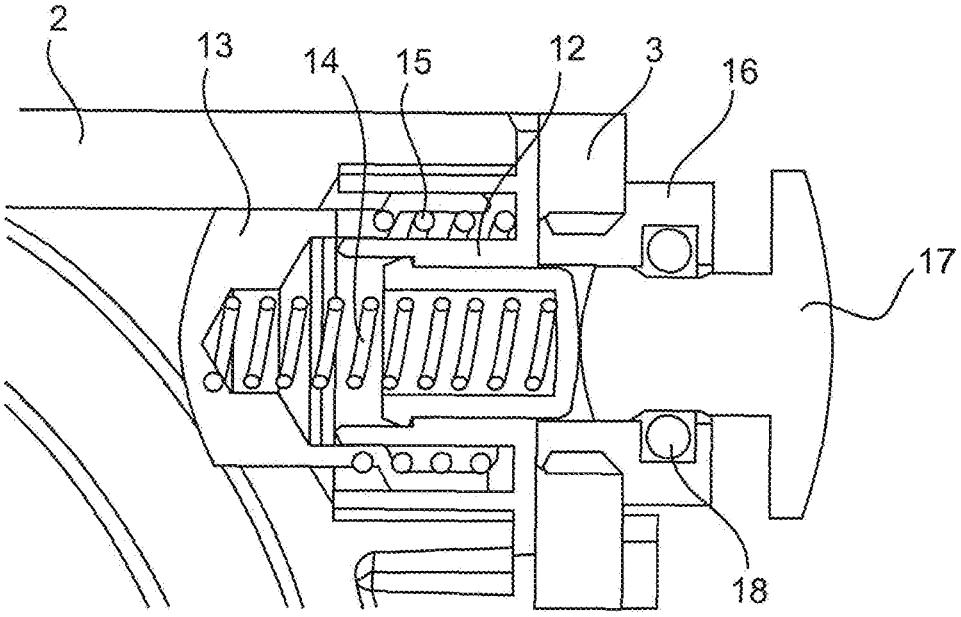
FIG. 4 is a further sectional illustration of the cutout in the plug connector housing and the cutout, flush therewith, in the locking clip.

In FIGS. 3 and 4, the respective cutouts of the plug connector housing 2 and the locking clip 3 are mutually flush. In FIG. 3, the bolt 11 is initially still located within the plug connector housing 2.

With flush cutouts and in the mated state of the plug connector 1, the bolt 11 is pressed into the cutout of the locking clip 3 by the spiral spring 14, whereby this locking clip is fixed in place. A further pivotal movement of the locking clip 3 is no longer possible in this situation. The flush cutouts of the plug connector housing 2 and locking clip 3 are arranged such that, in this case, the locking clip 3 is in a position in which it acts on the pins 9 of a mating plug connector 10. In this locked state, the system comprising the plug connector 1 and mating plug connector 10 can no longer be inadvertently opened and mutually disconnected.

The bolt 11 located in the cutout of the locking clip 3 can be pressed back into a position within the plug connector housing 2—in opposition to the spring force of the spiral spring 14—by the actuator 17. The locking clip 3 can then be pivoted away from the mating plug connector 10 again. The plug connector 1 and the mating plug connector 10 can be mutually disconnected. By actively releasing a mating connection via an actuator 17, this is a conscious action on the part of a user. An inadvertent "removal under load" is thus prevented.

Figure 5:
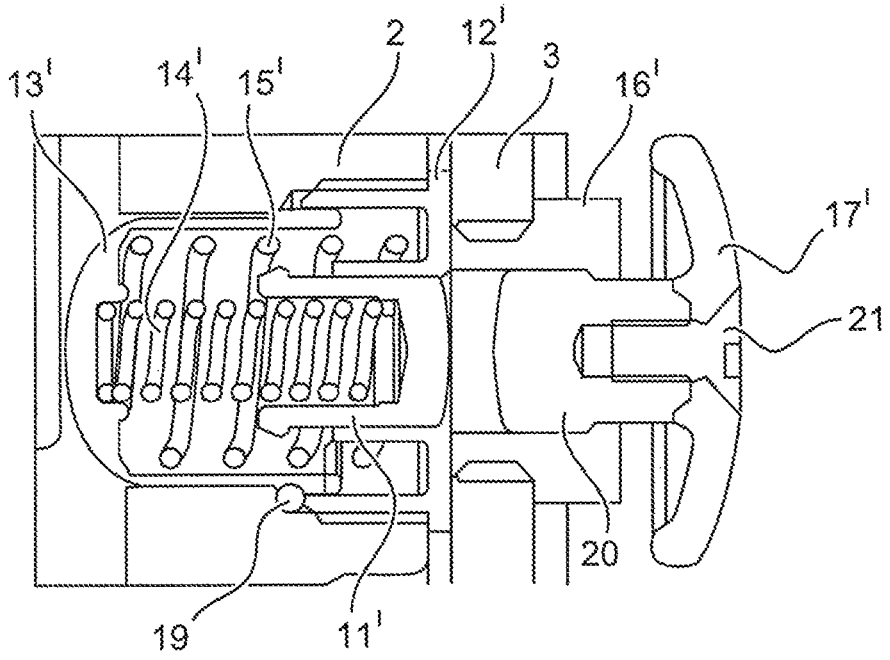
FIG. 5 is a sectional illustration of a cutout of an alternative plug connector housing and cutout, flush therewith, in the locking clip.
Figure 6:
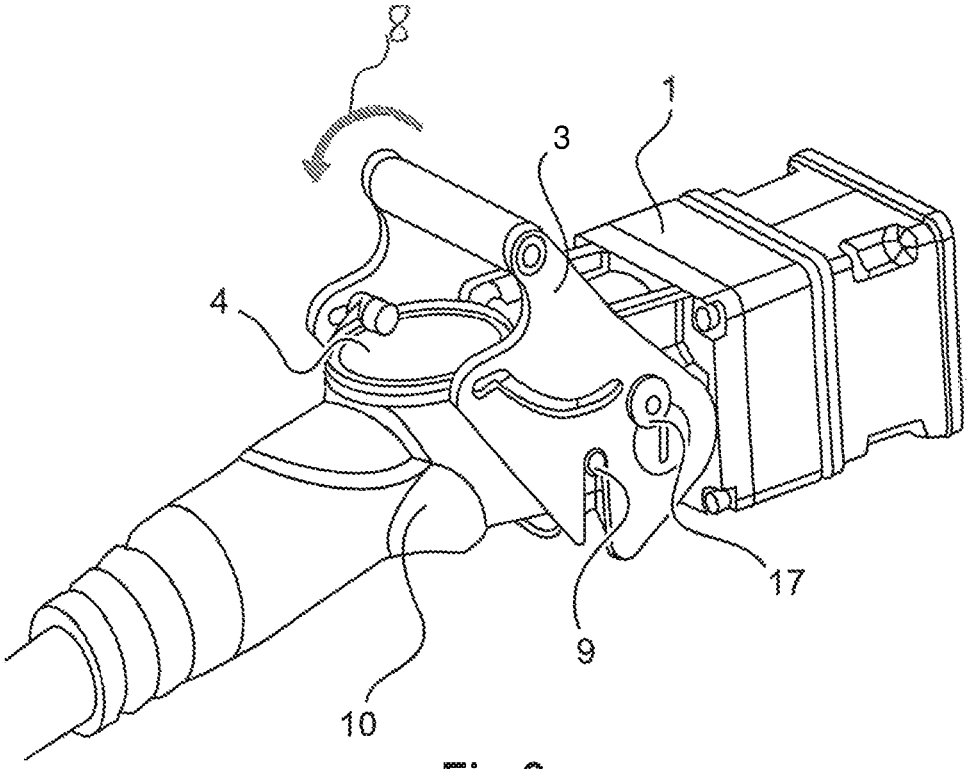
FIG. 6 shows a system of a plug connector in the mated state with a mating plug connector.

An alternative embodiment of the actuating mechanism on the locking clip 3 is shown in FIG. 5. The hollow body in the trough part 13' is configured in such a way that the spring 14', which drives the bolt 11' for locking the locking clip 3, and the spring 15', which drives the trough part 13' into the mating area of the plug connector 1, are both supported on the base of the trough part 13'. The actuator 17' is configured in two parts and comprises a guide bolt 20, which is mounted in the guide element 16'. A blocking ring 18—such as that in the first embodiment—can thus be omitted. The actuator is connected to the guide bolt 20 via a screw 21. The cutout in the locking clip 3 can be sealed via an optional seal 19.

LIST OF REFERENCE SIGNS

1 Plug connector
2 Plug connector housing
3 Locking clip
4 Cover
5 Spring
6 Pin
7 Guide groove
8 Arrow
9 Pin
10 Mating plug connector
11 Bolt
12 Guide element
13 Trough part
14 Spiral spring
15 Spiral spring
16 Guide element
17 Actuator
18 Blocking ring
19 Seal
20 Guide bolt
21 Screw
22 Contact element

The invention claimed is:

1. A plug connector, comprising:

a plug connector housing;

at least one first cutout incorporated in the plug connector housing;

a trough part arranged in the at least one first cutout of the plug connector housing;

a bolt movably arranged within the at least one first cutout; and a locking clip, which is pivotably attached to the plug connector housing and has at least one second cutout, wherein the trough part projects into a mating area of the plug connector in an unmated state of the plug connector, and wherein the trough part is pressed out of the mating area towards the locking clip by a mating plug connector in a mated state of the plug connector, and wherein the at least one first cutout and the at least one second cutout are aligned mutually flush in a locked state with the mating plug connector, and wherein the bolt arranged in the at least one first cutout projects into the at least one second cutout of the locking clip in the locked state, whereby the locking clip is fixed in terms of its pivotal movement.

2. The plug connector as claimed in claim 1, wherein the bolt is arranged in and movable relative to the trough part.

3. The plug connector as claimed in claim 2, wherein the bolt is arranged on a spring in the trough part.

4. The plug connector as claimed in claim 2, wherein a guide element is arranged in the at least one first cutout of the plug connector, the guide element being operatively connected to the trough part in a resilient manner.

5. The plug connector as claimed in claim 4, wherein the bolt is movably mounted in the guide element.

6. The plug connector as claimed in claim 1, wherein an actuator is movably mounted in the at least one second cutout of the locking clip.

7. The plug connector as claimed in claim 6, wherein a force can be exerted on the bolt via the actuator, whereby the bolt can be removed from the at least one second cutout of the locking clip.

8. The plug connector as claimed in claim 1, wherein the plug connector has a cover which seals a mating face of the plug connector in a media-tight manner in an unmated state.

9. A system, comprising the plug connector as in claim 1 and a matching mating plug connector.

* * * * *